US005919031A

United States Patent [19]

Hall et al.

[11] Patent Number: 5,919,031

[45] Date of Patent: Jul. 6, 1999

[54] COOLABLE BLADE

[75] Inventors: Kenneth Hall, Richterswil; Bruce Johnson, Baden-Dättwil, both of Switzerland; Bernhard Weigand, Waldshut-Tiengen, Germany; Pey-Shey Wu, Baden-Dättwil, Switzerland

[73] Assignee: Asea Brown Boveri AG, Baden, Switzerland

[21] Appl. No.: 08/897,765

[22] Filed: Jul. 21, 1997

[30] Foreign Application Priority Data

Aug. 23, 1996 [DE] Germany ..... 196 34 238

[51] Int. Cl.[6] ..... F01D 5/18

[52] U.S. Cl. ..... 416/96 R; 415/115

[58] Field of Search ..... 415/115, 116; 416/96 R, 96 A, 97 R, 97 A

[56] References Cited

U.S. PATENT DOCUMENTS 3,806,274 4/1974 Moore ..... 416/97
5,403,157 4/1995 Moore ..... 416/96 R

FOREIGN PATENT DOCUMENTS 1247072 8/1967 Germany .
3248162 12/1994 Germany .
1410014 10/1975 United Kingdom ..... 416/97 R

*Primary Examiner*—Christopher Verdier
*Assistant Examiner*—Richard Woo
*Attorney, Agent, or Firm*—Burns, Doane, Swecker & Mathis, L.L.P.

[57] ABSTRACT

A coolable blade (10) essentially comprises a blade root (11) and a blade body (1), which is composed of a pressure-side wall (6) and a suction-side wall (5). They are connected to one another essentially via a trailing-edge region (4) and a leading-edge region (3) in such a way that at least one hollow space (2) used as a cooling-fluid passage is formed, in which ribs (7) are arranged. At least one rib (7) is configured in such a way that it has an apex (9) and two legs (14, 15), the legs (14, 15) of the rib being bent at an acute angle (8) relative to a radial plane (13). It is especially advantageous to arrange these ribs in a hollow space of double triangular shape having acute-angled triangular points in the region of the leading edge and the trailing edge.

17 Claims, 2 Drawing Sheets

COOLABLE BLADE

BACKGROUND OF THE INVENTION

1. Field of the Invention

The invention relates to a coolable blade according to the preamble of the first claim.

2. Discussion of Background

DE 32 48 162, for example, discloses such coolable blades. In this publication, a coolable blade is described which has a cooling-fluid passage in its leading-edge region. Ribs for initiating and promoting turbulence extend over the width of the cooling-fluid passage and are arranged at an acute angle, approximately 30°, to the inside of the leading-edge wall obliquely against the direction of flow of the cooling fluid in the cooling-fluid passage. The ribs are therefore oriented in such a way that the cooling air is directed to the leading edge of the blade. In this case, the rib height is between 10 to 33% of the height of the cooling-fluid passage. At the same time, the rib height is in each case constant over the width of the cooling-fluid passage and the cooling arrangement can only be used for the nose passage in the region of the leading edge.

In the rear stages of a modern gas turbine, the high outside temperature likewise requires the blade to be cooled, although the blade here is of a very slim form for aerodynamic reasons. This results in an essentially double triangular-shaped coolant passage having acute-angled triangular points in the region of the leading and trailing edge of the blade. The flow resistance is very high in the region of the acute-angled triangular points and therefore virtually no cooling takes place in these regions.

SUMMARY OF THE INVENTION

Accordingly, one object of the invention, in the case of a coolable blade of the type mentioned at the beginning, is to improve the cooling of the blade and increase the service life of the blade.

This is achieved according to the invention by the features of the first claim.

The essence of the invention is therefore that at least one rib is configured in such a way that it has an apex and two legs and that the legs of the rib are bent at an acute angle relative to a radial plane.

The advantages of the invention may be seen, inter alia, in the fact that the blade is evenly cooled due to the configuration of the ribs having an apex and two legs and the consumption of cooling fluid can be reduced. This is effected essentially by avoiding wake zones in the region of the leading and trailing edge of the coolant passage of the blade. By the cooling of the blade, the surface temperature is evened out and the thermal stresses in the blade are reduced, whereby the service life of the blade is increased. The efficiency of the turbine can be increased due to the reduced consumption of cooling fluid. Depending on the external thermal load on the blade, the rib geometry in the cooling-fluid passage can be adapted and therefore an even surface temperature of the blade can be achieved. In addition, blades having ribs arranged in the hollow space are simple to manufacture by casting.

It is especially advantageous to arrange the ribs having an apex and two legs in a hollow space of double triangular shape having acute-angled triangular points in the region of the leading edge and the trailing edge. It is thereby possible to effectively cool by means of a double triangular-shaped coolant passage even blade profiles of very slim form, which have a high aerodynamic efficiency.

It is advantageous to keep the ratio of local rib height to local hollow-space height constant. The local rib height in the region of the leading and trailing edge is thereby reduced compared with the local rib height in the region of the hollow-space center, as a result of which the secondary flow is intensified.

Further advantageous developments of the invention follow from the further subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a blade of a fluid-flow machine, wherein.

DESCRIPTION OF THE PREFERRED EMBODIMENTS

Figure 1:
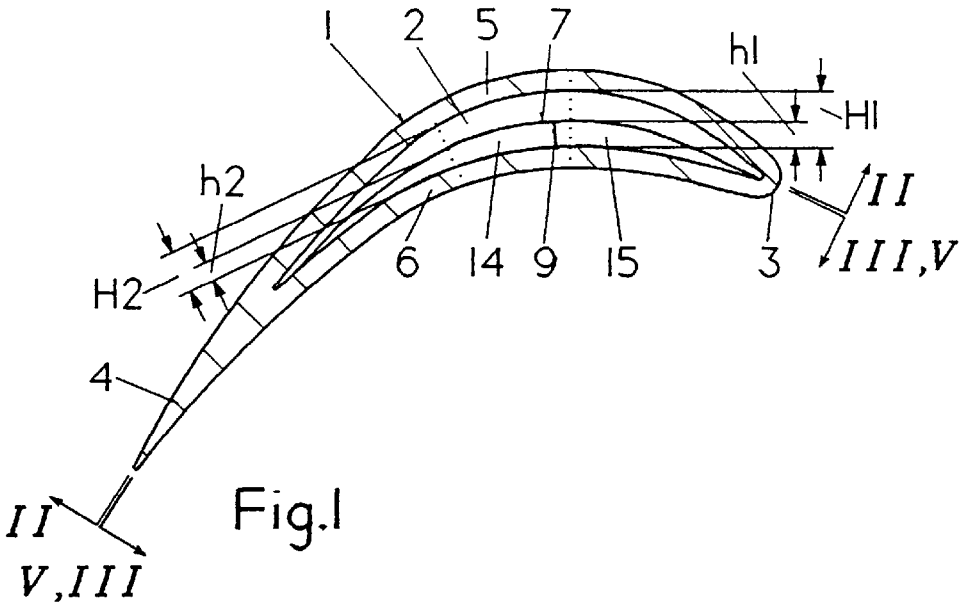
FIG. 1 shows a partial cross section through a body of the blade.

Referring now to the drawings, wherein like reference numerals designate identical or corresponding parts throughout the several views and only the elements essential for understanding the invention are shown, in FIG. 1 a blade body 1 of a fluid-flow machine having a hollow space 2 is shown in cross section, the hollow space serving as a cooling-fluid passage. The blade body 1 has a leading-edge region 3, a trailing-edge region 4, a suction-side wall 5 and a pressure-side wall 6, the suction-side wall and the pressure-side wall being connected to one another in the region of the leading edge 3 and the trailing edge 4. This results in an essentially double triangular-shaped coolant passage having acute-angled triangular points in the region of the leading edge 3 and the trailing edge 4 of the blade. A V-shaped rib 7 having an apex 9 and legs 14, 15 is arranged on the pressure-side wall 6. In this case, the V-shaped rib 7 may be designed with legs of equal length; however, depending on the arrangement of the rib apex 9 in the hollow space, rib configurations having legs of unequal length are also possible. In this arrangement, a ratio of a height h1 of the rib 7 to a local height H1 of the hollow space 2 is the same size as a ratio of a height h2 of the rib 7 to a local height H2 of the hollow space 2. The ratio of rib height h to hollow-space height H is therefore essentially the same at each point of the rib. In the regions where the hollow space 2 merges into the leading- and trailing-edge region, the rib 9 narrows in order not to inhibit the passage of the cooling fluid in these regions.

Figure 2:
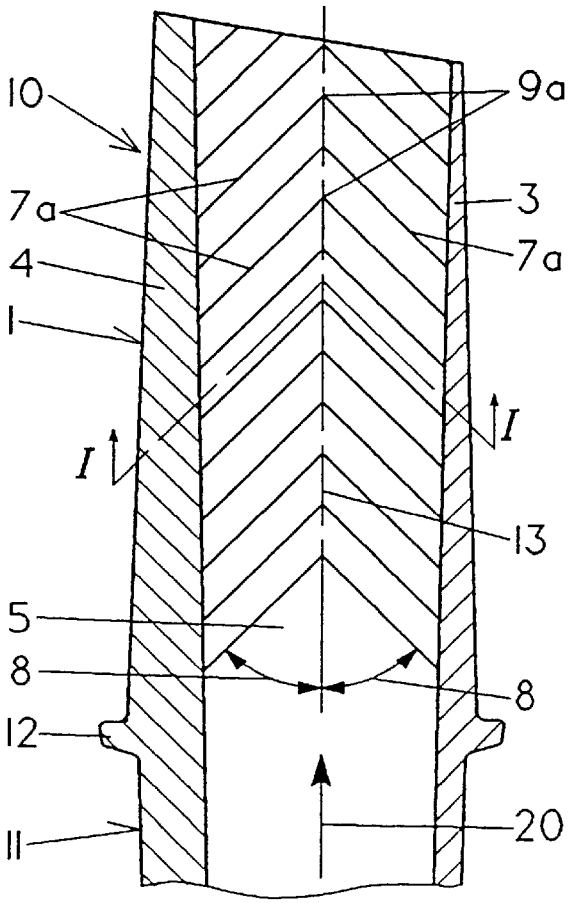
FIG. 2 shows a partial longitudinal section through the blade along line II—II in FIG. 1.

FIG. 2 shows the inside of the suction-side wall 5 with sectioned leading-edge region 3 and trailing-edge region 4. Here, a blade 10 of a fluid-flow machine consists of the blade body 1 and the blade root 11, with which the blade 10 can be mounted. A platform 12 is normally arranged between blade body 1 and blade root 11, which platform 12 shields the blade root from the fluid flowing around the blade body. V-shaped ribs 7*a* are likewise arranged on the suction-side wall, an apex 9*a* of the ribs being arranged here on a plane 13 of the hollow space 2, and the apex 9*a* lying downstream. The plane 13 runs radially to the blade and perpendicularly to the insides of the walls 5 and 6 of the blade and is arranged at the widest point of the hollow space 2. The apex 9*a* therefore lies at the point where the local rib height h is at a maximum.

A cooling fluid 20 is passed through the hollow space 2 starting from the blade root. In this arrangement, the ribs are bent at an angle 8 to the main flow direction of the cooling fluid 20, the main flow direction running essentially parallel to the plane 13. In this case, the angle 8 is 30 to 60°, preferably 40 to 50°, and in particular 45°. Vortices and recirculation zones which increase the heat-transfer coefficient are produced downstream of the V-shaped ribs.

TABLE 1

Average Nusselt number as a function of the height of the V-shaped rib (from experimental data)

| Ratio of rib height/ hollow-space height [%] | 0 | 18 | 31 | 44 |
|---|---|---|---|---|
| $Nu/Nu_{smooth}$ | 1 | 2–4 | 5–7 | 9–12 |

The Nusselt number Nu is defined as the ratio of the convectively dissipated heat quantity to the conducted heat quantity. In Table 1, the average Nusselt number Nu for various rib heights is compared with the Nusselt number $Nu_{smooth}$ of a passage without ribs, the apexes of the V-shaped ribs being arranged downstream. It can clearly be seen from Table 1 that the average Nusselt number greatly increases with increased rib height. The ratio of local rib height to local hollow-space height should therefore be between 5 to 50%, preferably between 20 to 40%.

Since the temperature of the cooling fluid increases in the direction of flow by absorbing thermal energy and thus the difference between wall temperature and cooling fluid decreases, the ratio between local rib height h and local hollow-space height H can be continuously increased in the direction of flow, whereby, according to the above Table 1, the Nusselt number is increased and the heat transfer is thus improved. The thermal energy absorbed by the cooling fluid is thereby adapted to the external thermal load of the blade. This leads to the temperature distribution being additionally evened out in the radial direction of the blade and thus to distinctly lower stresses.

Figure 3:
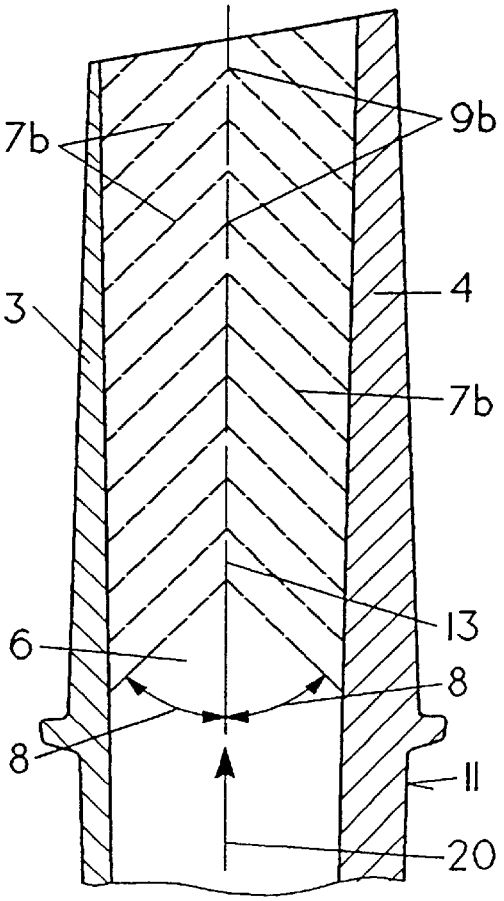
FIG. 3 shows a partial longitudinal section through the blade along line III—III in FIG. 1.

FIG. 3 shows the inside of the pressure-side wall 6 with sectioned leading-edge region 3 and trailing-edge region 4. The ribs 7*b* arranged on the inside of the pressure-side wall 6 are likewise V-shaped, their apex 9*b* being arranged on the plane 13 of the hollow space 2. The apex 9*b* therefore lies at the point where the local rib height h is at a maximum. As can be seen from FIG. 3, the ribs on the suction and pressure side are arranged offset from one another in the direction of flow.

Figure 4:
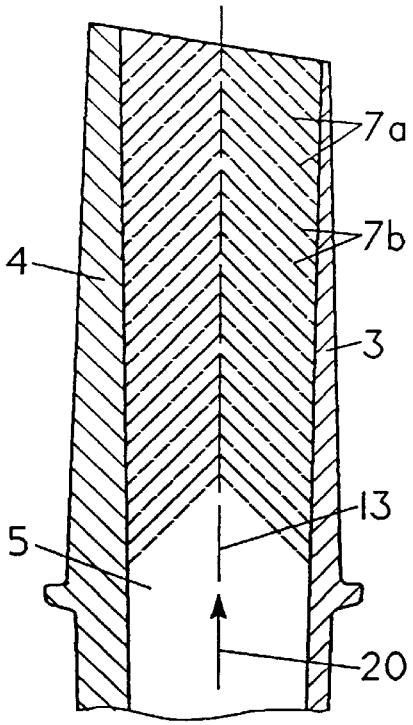
FIG. 4 shows a partial longitudinal section through the blade offset in parallel from line II—II in FIG. 1.

The mutual arrangement of the ribs 7*a* and 7*b* can be seen from FIG. 4. The ribs are offset from one another in the direction of flow, so that the flow successively strikes a rib 7*a* of the suction side 5 and a rib 7*b* of the pressure side 6. The ribs are in each case advantageously arranged in the center between the ribs of the opposite wall.

Due to the arrangement according to FIG. 4, the flow is passed into the acute-angled regions of the leading and trailing edge, as a result of which a distinctly higher local Nusselt number than the average Nusselt number indicated in Table 1 is achieved. Very high heat-transfer coefficients are therefore achieved in the region of the leading and trailing edge of the blade, whereas lower heat-transfer coefficients occur in the region of the passage center.

Figure 5:
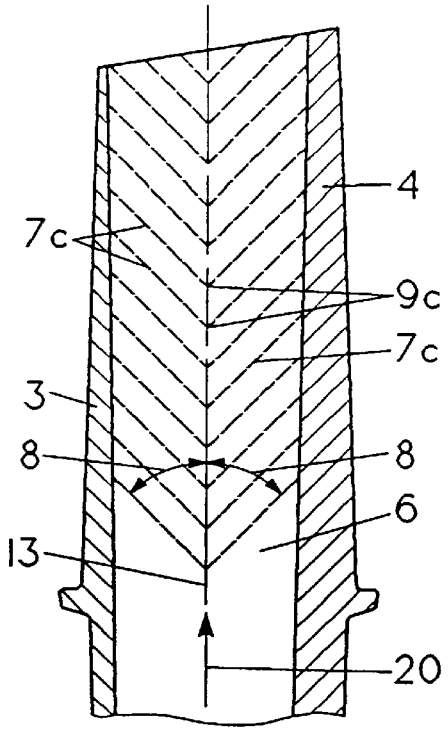
FIG. 5 shows a partial longitudinal section through the blade along line V—V in FIG. 1.

FIG. 5 shows the inside of the pressure-side wall 6 with sectioned leading-edge region 3 and trailing-edge region 4 of the blade 10, which consists of the blade body 1 and the blade root 11. In contrast to FIG. 3, the ribs 7*c* of the pressure-side wall are arranged in such a way that the flow is first admitted to their apex 9*c*. In this case, the ribs are likewise bent at the angle 8 to the main flow direction of the cooling fluid 20.

Figure 6:
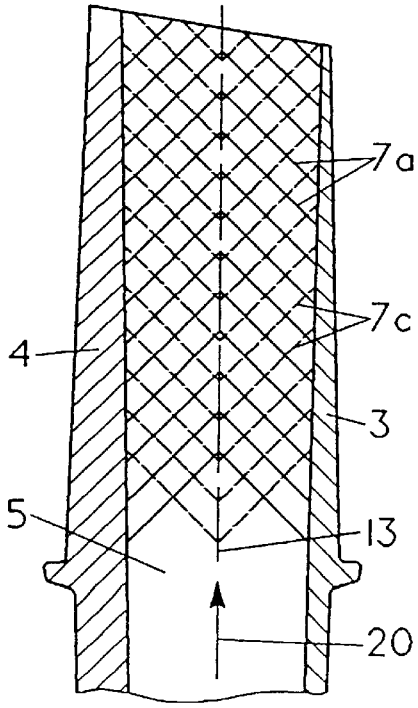
FIG. 6 shows a partial longitudinal section through the blade offset in parallel from the line V—V in FIG. 1.

FIG. 6 shows the suction-side wall with ribs 7*a* and intimated ribs 7*c*, the ribs 7*a* being arranged in accordance with FIG. 2 on the suction side. Here, for design reasons, the ratio of local rib height to local hollow-space height is of course always less than 50%.

Likewise very high heat-transfer coefficients are achieved by the arrangement according to FIG. 6, which heat-transfer coefficients, however, are more evenly distributed than in the arrangement according to FIG. 4. However, the heat-transfer coefficients of a blade according to FIG. 6 are different on the pressure side and the suction side, as a result of which this arrangement is used in the case of a different thermal load on the pressure side and the suction side.

The invention is of course not restricted to the exemplary embodiment shown and described. The V-shaped ribs may also be arranged in blades having a plurality of cooling-air passages, if a high flow resistance prevails in the marginal zones of the cooling-air passages.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A coolable blade, essentially comprising a blade root and a blade body, which is composed of a pressure-side wall and a section-side wall, which are connected to one another essentially via a trailing-edge region and a leading-edge region in such a way that at least one hollow space used as a cooling-fluid passage is formed, in which ribs are arranged, wherein at least one rib is configured in such a way that it has an apex and two legs, wherein the legs of the at least one rib are bent at an acute angle relative to a radial plane;

wherein a ratio of a local rib height to a local hollow-space height is essentially constant at each point of the at least one rib; and wherein the ratio of the local rib height to the local hollow-space height is 5–50%.

2. The coolable blade as claimed in claim 1, wherein the hollow space is of double triangular shape having acute-angled triangular points in the region of the leading edge and the trailing edge.

3. The coolable blade as claimed in claim 1, wherein the apex of the at least one rib is arranged in a region of the greatest local height of the at least one rib.

4. The coolable blade as claimed in claim 1, wherein the ratio of the local rib height to the local hollow-space height increases for ribs arranged one after the other in a direction of flow.

5. The coolable blade as claimed in claim 1, wherein apexes of the ribs on the suction-side wall and the pressure-side wall lie downstream.

6. The coolable blade as claimed in claim 1, wherein apexes of the ribs on the suction-side wall or the pressure-side wall lie downstream and on the opposite wall lie upstream.

7. The coolable blade as claimed in claim 1, wherein the legs of the at least one rib are bent at an angle of 30° to 60° relative to the radial plane.

8. A coolable blade, essentially comprising a blade root and a blade body, which is composed of a pressure-side wall and a section-side wall, which are connected to one another essentially via a trailing-edge region and a leading-edge region in such a way that at least one hollow space used as a cooling-fluid passage is formed, in which ribs are arranged;

wherein at least one rib is configured in such a way that it has an apex and two legs, wherein the legs of the at least one rib are bent at an acute angle relative to a radial plane;

wherein a ratio of a local rib height to a local hollow-space height is essentially constant at each point of the at least one rib; and wherein the ratio of the local rib height to the local hollow-space height increases for ribs arranged one after the other in a direction of flow.

9. The coolable blade as claimed in claim 8, wherein the hollow space is of double triangular shape having acute-angled triangular points in the region of the leading edge and the trailing edge.

10. The coolable blade as claimed in claim 8, wherein the apex of the at least one rib is arranged in a region of a greatest local height of the rib.

11. The coolable blade as claimed in claim 8, wherein apexes of the ribs on the suction-side wall or the pressure-side wall lie downstream and on the opposite wall lie upstream.

12. The coolable blade as claimed in claim 8, wherein the legs of the at least one rib are bent at an angle of 30° to 60° relative to the radial plane.

13. A coolable blade, essentially comprising a blade root and a blade body, which is composed of a pressure-side wall and a section-side wall, which are connected to one another essentially via a trailing-edge region and a leading-edge region in such a way that at least one hollow space used as a cooling-fluid passage is formed, in which ribs are arranged;

wherein at least one rib is configured in such a way that it has an apex and two legs, wherein the legs of the at least one rib are bent at an acute angle relative to a radial plane;

wherein a ratio of a local rib height to a local hollow-space height is essentially constant at each point of the at least one rib; and wherein apexes of the ribs on the suction-side wall and the pressure-side wall lie downstream.

14. The coolable blade as claimed in claim 13, wherein the hollow space is of double triangular shape having acute-angled triangular points in the region of the leading edge and the trailing edge.

15. The coolable blade as claimed in claim 13, wherein the apex of the at least one rib is arranged in a region of a greatest local height of the rib.

16. The coolable blade as claimed in claim 13, wherein apexes of the ribs on the suction-side wall or the pressure-side wall lie downstream and on the opposite wall lie upstream.

17. The coolable blade as claimed in claim 13, wherein the legs of the at least one rib are bent at an angle of 30° to 60° relative to the radial plane.

* * * * *